United States Patent [19]

Horan et al.

[11] 4,247,109

[45] Jan. 27, 1981

[54] PINBALL MACHINE AND FLEXIBLE SHEETS WITH CIRCUIT THEREFOR

[75] Inventors: William F. Horan, Middletown; David P. Weindel, East Greenwich; both of R.I.; Paul J. Sullivan, Ker Arvor, Harrison Ave., Newport, R.I. 02840; Ernest H. Bridge, Jr., Tiverton, R.I.

[73] Assignee: Sullivan, Paul J., Newport, R.I.

[21] Appl. No.: 929,161

[22] Filed: Jul. 28, 1978

[51] Int. Cl.[2] ..... A63D 3/02

[52] U.S. Cl. ..... 273/121 A; 200/61.11

[58] Field of Search ..... 273/121 A, 123 A, 124 A, 273/126 A, , 118 A, 119 A, 120 A, 122 A; 200/61.11, 61.1; 272/4

[56] References Cited

U.S. PATENT DOCUMENTS

| | | | |
|---|---|---|---|
| 1,386,517 | 8/1921 | Lellis | 273/123 A UX |
| 2,102,860 | 12/1937 | Stoner et al. | 273/121 A |
| 2,209,589 | 7/1940 | Williams et al. | 200/61.11 |
| 2,577,222 | 12/1951 | Wiser | 273/121 A |
| 2,977,429 | 3/1961 | Zimmeman | 200/61.11 |
| 3,348,844 | 10/1967 | Lemelson | 273/121 A |
| 3,784,768 | 1/1974 | Hunt | 272/4 X |
| 3,860,388 | 1/1975 | Haigh | 101/470 |
| 4,014,546 | 5/1975 | Steinkamp | 273/102.2 S |
| 4,028,509 | 6/1977 | Zurcher | 200/5 A |

FOREIGN PATENT DOCUMENTS

| | | | |
|---|---|---|---|
| 572250 | 1/1976 | Switzerland | 272/4 |

*Primary Examiner*—Richard T. Stouffer

*Attorney, Agent, or Firm*—Salter & Michaelson

[57] ABSTRACT

A game apparatus is disclosed in which a playing piece such as a ball, puck and the like is adapted to move over or strike a playing surface in turn formed by one of a pair of flexible sheets on which electrical circuitry is disposed. Another sheet having openings at preselected areas is disposed between the flexible sheets so as to normally maintain pairs of contact portions of the circuits in opposed spaced relationship to each other. As a playing piece moves over such preselected areas, its weight causes the first flexible sheet to become downwardly depressed such that a contact pair of circuits is electrically closed and a game event is signalled thereby. The game may be a pinball machine including electronic/microelectric circuitry, as a game processor input subsystem, and an alpha-numeric score-keeping readout and may also include audio and visual signals.

7 Claims, 7 Drawing Figures

PINBALL MACHINE AND FLEXIBLE SHEETS WITH CIRCUIT THEREFOR

BACKGROUND AND SUMMARY OF THE INVENTION

This invention relates to games and particularly games utilizing boards on which a playing piece is moved thereover by a player's skill and/or luck in such a manner that game events are signalled by such movement. As such, the invention has particular utility with pinball machine constructions but is not limited to such devices.

In such pinball and related game devices, the circuitry necessary in order to record scores and other game events as the ball or other playing piece progresses about the surface of the game board has generally taken the form of relatively complex mechanical or electro-mechanical components which do not lend themselves to use with state of the art microelectronic circuits such as utilized in calculators, digital watches and the like. One such game construction is shown by U.S. Pat. No. 3,348,844 issued Oct. 24, 1967, in which a game board is provided with rigid conductive electrical conductive strips which form a partial circuit with contact closure caused by a conductive game piece which bridges such strips as it rolls over selected areas of the board. A further game device in which a conductive game piece brings about contact closure between circuit portions is shown in U.S. Pat. No. 1,386,517 issued Aug. 2, 1921. The patents above cited and the discussion thereof constitutes applicant's Prior Art Disclosue and in that regard a copy of each such patent is enclosed with this application.

It is accordingly a primary object of the present invention to provide a game construction having a playing board including electrical circuitry such that the movement of a game piece thereover flexes said board to cause such circuitry to be activated such that game events including scores and the like may be signalled.

A further object of the present invention is the provision of a game construction of the above-indicated type in which the circuitry thereof is specifically adapted to interface with known microelectronic circuits as utilized in calculators and the like.

A still further object of the present invention is the provision of a game construction of the above-identified type in which one of the game events signalled by such circuitry includes the tilting of the game board surface away from its normal playing position.

These and other objects of the present invention are achieved by the provision of a game board having a playing surface formed by the outer surface of a flexible material sheet on which a first partial electrical circuit is disposed on the inner surface thereof. A second partial electrical circuit which is complementary to the first circuit is positioned in spaced relationship to the inner surface of said sheet with selected portions of each of said circuits opposed to each other to form pairs of opposed contacts such that as a playing piece supported by the playing surface moves thereacross, said piece inwardly flexes portions of the sheet such that one of said contact pairs are brought into mutual contact so as to signal a game event.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
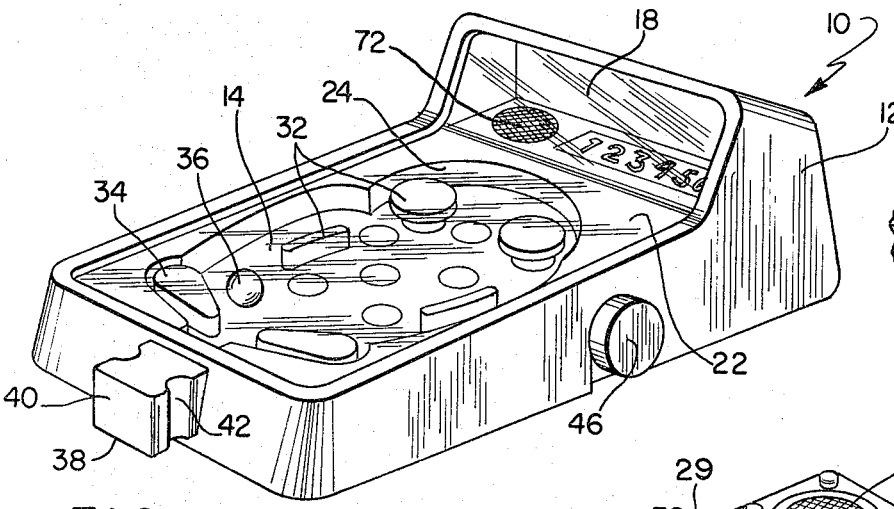
FIG. 1 is a perspective view of a pinball machine embodying the present invention.

Turning now to the drawing and particularly FIG. 1, a game construction in the form of a pinball machine 10 is shown. The pinball machine 10 shown is adapted primarily for hand held operation and is representative of the type game constructions encompassed by the present invention. However, the present invention has utility in a large number of game constructions whether they be hand or floor supported and other than the particular pinball type shown.

The pinball machine 10 includes a cover 12, a transparent first panel 14 through which a playing surface 16 is visible and a transparent second panel 18 through which a scoring panel 20 is visible. The first panel 14 may include non-transparent portions 22 including downwardly extending peripheral walls 24 which define the perimetal shape of the playing surface 16. The cover 12 is adapted to interfit with a housing 26 having upstanding walls including a front wall 27, side walls 28, a rear end wall 29, and a bottom wall 30. Appropriately, supported from the bottom wall 30 and extending above the playing surface 16 are stationary bumpers 32 and a pair of movable bumpers or flippers 34 such that a ball or other movable playing piece 36 may be guided in part by skill and in part by luck about the playing surface 16.

As with conventional pinball machines, this machine supports the playing surface 16 in a somewhat angular or slanted disposition such that the ball 36 will move by gravity towards the lower end wall 27. A spring actuated plunger or hammer 38 serves to propel the ball 36 on to the playing surface in the normal manner. Such plunger includes a finger grip 40 including recessed portions 42 for ease in grasping. The grip may be longitudinally withdrawn against the action of a spring (not shown) to compress the same and once released, resiliently drives the forward end of the plunger 44 against the ball 36 so as to propel the same over the playing field 16. In this regard, the walls 24 defining the perimetal extent of the playing surface 16 are shaped so as to direct an already played ball by gravity into contact with the plunger 44. The same ball may then be repeatedly utilized. Actuators 46 operable to bring about reciprocal movement of the flippers 34 are provided on opposite sidewalls 28 so that such may be conveniently manipulated by the players' hands. Conventional mechanical linkage (not shown) serves to interconnect the actuators 46 with the flippers 34 to effect such action.

Figure 3:
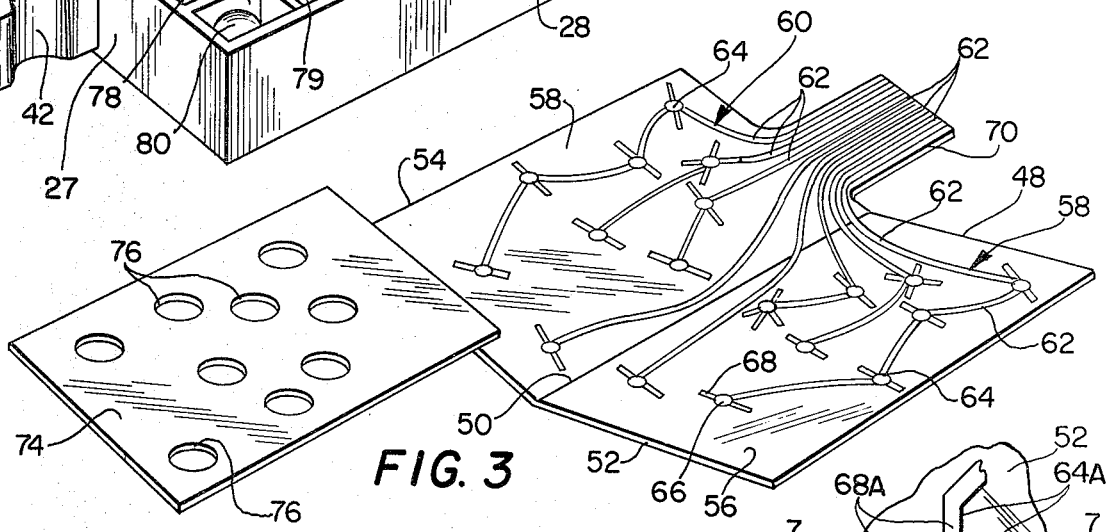
FIG. 3 is a perspective partially exploded view of a portion of the device shown in FIGS. 1 and 2.

Turning now to FIG. 3 of the drawing in particular, it may be seen that the playing field 16 is defined by the outer surface of one portion of a flexible material sheet 48 adapted to be folded upon itself about fold line 50 so as to form an upper sheet segment 52 and a lower sheet segment 54. The inner surfaces 56 and 58 of the sheet segments 52 and 54 respectively, are each provided with a partial electrical circuit 58 and 60, respectively, which may be printed thereon or otherwise applied. The circuits 58, 60 include a plurality of individual conductors 62 and contacts 64. When the sheet segments 52,54 are disposed in overlying relationship to each other, the contacts 64 of one sheet segment are adapted to oppose a similar contact on the other sheet segment. The contacts 64 are in the form of a central area 66 having an outwardly extending arm or bar 68, which bars are preferably adapted to overlap in crisscross fashion the bar 68 of the opposing contact 64 in the opposite sheet segment. It should be clear that the partial circuits 58 and 60 are interrelated such that when selected pairs of overlying contacts 64 thereof are brought into physical contact with each other, an electrical circuit is completed such that a game event may be signalled to the scoreboard 20 by means of a connecting tail 70 longitudinally extending from either of the sheet segments 52, 54 and electronically interconnected with the scoreboard 20 in a known manner. The scoreboard 20 may include an alpha or numerical display such as normally utilized in connection with calculators and the like and may also include a miniature speaker 72 such that game events may be signalled other than by numerical scoring, i.e. as by audible signals or by a combination of visual and audible signals. Also, lights or other signal devices could be used in conjunction with or in place of the sound and visual scoring means above indicated.

Figure 4:
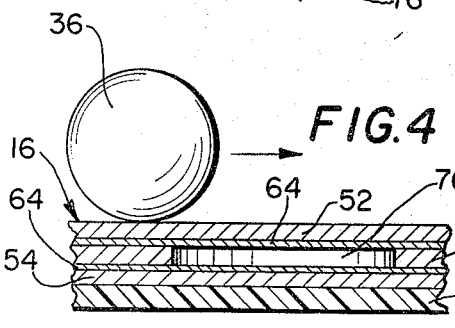
FIG. 4 is a partial sectional view taken along the line 4—4 of FIG. 2.
Figure 5:
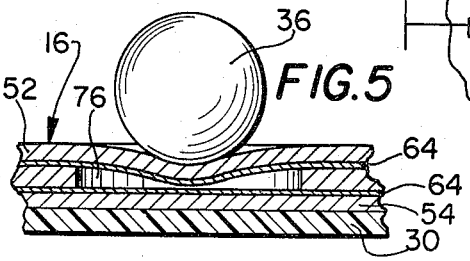
FIG. 5 is a partial sectional view similar to FIG. 4, but showing a playing piece disposed over a selected portion of the playing surface so as to depress such surface so as to activate a contact pair and accordingly signal a game event.

A non-conductive intermediate sheet 74 having a plurality of holes 76 extending therethrough, is disposed between the sheet segments 52 and 54 such that the contacts 64 of the circuit portions 58 and 60 are normally disposed in spaced opposed position to each other, that is, the holes 76 are disposed in locations corresponding to the number and location of the contacts 64. In this way then, and as best shown in FIG. 4, the contact pairs of a particular circuit will be disposed in opposed spaced relationship to each other by a distance substantially equal to the thickness of portions of the intersheet 74 adjacent the holes 76. When the ball or other playing piece 36 moves across those preselected portions of the playing surface 16 directly above a hole 76, the weight of the ball will force that portion of the upper sheet segment 52 overlying the hole downwardly so that physical and thus electrical contact is made between a contact pair of a particular circuit 62. Such contact in turn generates a signal which may be translated into a score or other event on the scoreboard 20 much in the manner that an event is signalled on a calculator by depression of a function button.

The sheet 48 forming the circuitry for the present device may be of the style, material and configuration shown in U.S. Pat. No. 4,028,509 issued June 7, 1977. The disclosure of that patent is hereby incorporated into the present specification by specific reference thereto. Obviously, however, the flexibility of the sheet which forms the playing surface 16 varies according to its thickness and material composition. A particular example possessing the desired sensitivity for the present application has been found to include a material sheet 48 formed of polyester film (Mylar, trademark of DuPont) 0.005 inches thick with an intersheet of Mylar or cardboard 0.003 inches thick. The ball utilized was a spherical steel ball weighing 2 ounces and 0.5 inches in diameter while the diameter of the circular holes 76 in such application was 0.5 inches.

Figure 2:
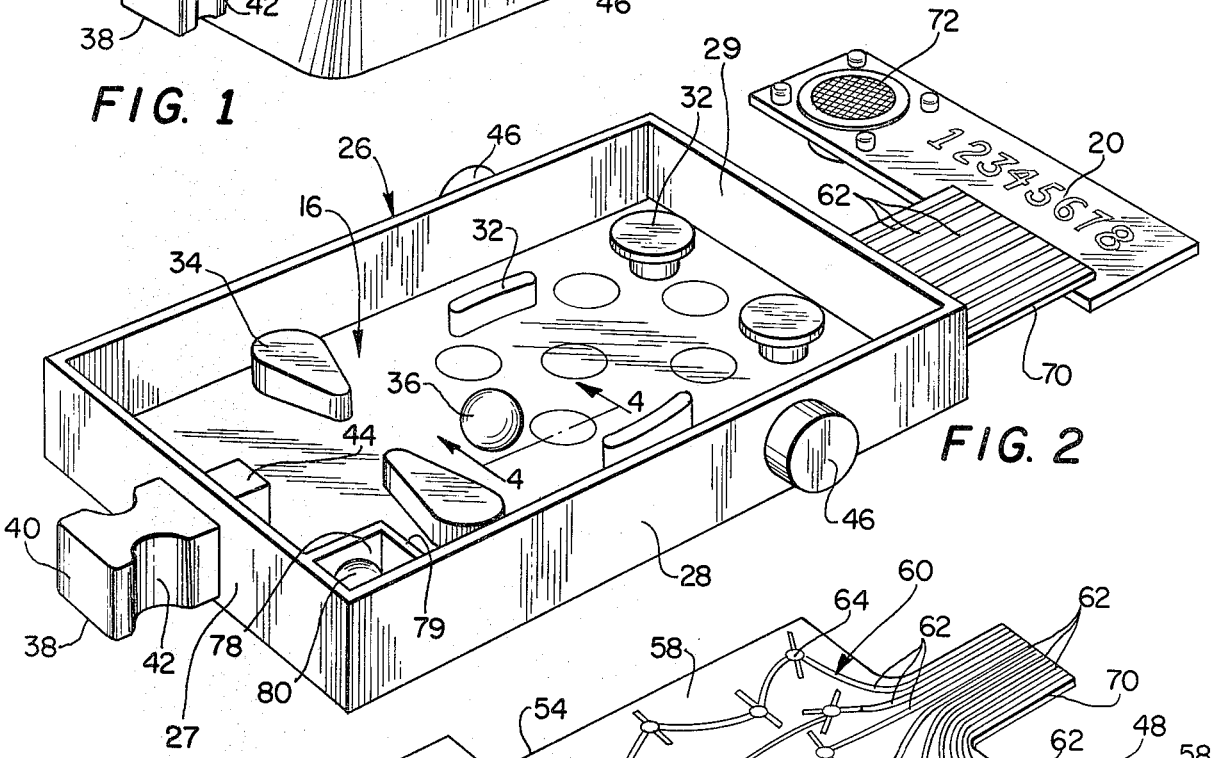
FIG. 2 is a partial perspective view of the pinball machine shown in FIG. 1 with parts removed for clarity.

It may thus be seen the openings 76 in the intersheet 74 correspond with play positions on the playing surface 16 as shown in FIGS. 1 and 2 of the drawing such that as the ball or other playing piece 36 moves across those particular portions of the playing surface 16, a game event occurs and is recorded on the score board or other device by the electrical signal formed by the respective touching of a contact pair 64. Known circuitry may be utilized to tally a score as such is created by the movement of the playing piece 36 over the playing surface 16. The game may include different scores for moving the playing piece over preselected playing surface portions disposed above openings 76 and may include bonus scores for sequencing the movement of the playing piece in a particular manner. Other functions achievable by the present invention include signalling the number of times the playing piece moves past a certain point whereby the number of turns played may be determined. Also, tilting of the game board may be signalled by the use of a compartment 78 within the housing 26 formed by upstanding walls 79 in which a ball 80 is disposed. The ball 80 may be moved back and forth by gravity between alternate positions within the compartment 78. One of such positions overlies an opening 76 such that the movement of the ball from a normal, non-tilt position to a tilt position will signal that a tilt has taken place and operate to signal the end of a particular game as by freezing of the score, the activation of a visible tilt signal, or a combination thereof.

Generally, the playing surface 16 is provided with a decorative format which may take the form of a thin separate paper or similar material sheet (not shown) which is adhesively connected preferably to the upper surface of the upper sheet segment 52. The decorative sheet should be of a thickness and flexibility so as not to interfere with the inward flexing of the material sheet segment 52. It has also been found desirable to utilize sublimation printing to achieve a decorative playing surface rather than the use of a separate decorative sheet. In such case, either the outer or inner surface of the sheet segment 52 undergoes sublimation printing such that various colored dyes are directly transmitted into the surface thereof in a desired pattern so as to create the decorative effect desired. Sublimation printing is a known technique and does not change the flexibility of the upper sheet segment 52 which forms the playing surface 16, as might happen in the case of the addition of a separate decorative paper sheet, and additionally does not utilize sulfur or other compounds found in paper or the adhesive that would normally be utilized to attach paper to the surface of the sheet segment 52, either of which may be detrimental to the sensitive circuitry utilized in this invention. Furthermore, while the game piece has been described in relationship to the specific pinball machine utilized as an example of the present invention, it should be emphasized that other game pieces such as discs, pucks, simulated automobiles, tanks and the like may be utilized with different type games, and may slide rather than roll across the playing surface 16.

Figure 7:
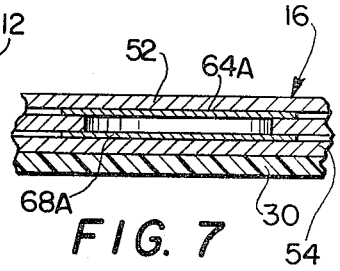
FIG. 7 is a partial sectional view taken along the line 7—7 of FIG. 6.
Figure 6:
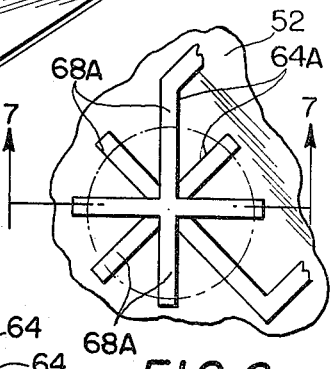
FIG. 6 is a partial plan view showing a modified form of electrical contact which may be utilized in the present invention.

Turning now to FIGS. 6 and 7 of the drawing, an alternate embodiment for the construction of the contacts 64A is shown. Therein, each contact segment is of cross-like configuration such that when the sheet segments 52, 54 on which they are formed are folded in opposed relationship to each other, the contacts 64A will form an extended criss-cross of crowsfoot configuration with the individual bars 68A of one sheet segment offset or staggered with respect to those of the other sheet segment such that relatively large contact masses are not disposed in opposed relationship to each other which can, in some instances, create a capacitance effect that may interfere with the signals generated by the circuitry utilized in the present device. Expressed differently, the cross-like contacts 64A assure good contact when pressed together, without utilizing an enlarged, concentrated contact that might create a capacitance problem. The bars 68 shown in FIG. 3 perform the same general function.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A game construction comprising a rigid housing, a game board supported by said housing, said game board having a playing surface formed by the outer surface of a pressure sensitive flexible first sheet, a first partial electrical circuit disposed on the inner surface of said first sheet, a second partial electrical circuit complementary to said first partial circuit disposed on the inner surface of a second sheet positioned in generally parallel opposition and in spaced relation to the inner surface of said first sheet with selected portions of each of said circuits opposed to each other to form a plurality of pairs of opposed contacts, means operatively associated with said circuits for signalling a game event when one of said contact pairs are in contact with each other, an intermediate non-conductive sheet disposed between said first and second sheets for normally maintaining said contact pairs apart from each other, said intermediate sheet having openings in alignment with said opposed contact pairs whereby inward flexing of said first sheet at said contact locations causes closing of said opposed contacts, said first and second sheets being formed from thin, resinous plastic material, and a playing piece adapted to be supported by and to move across said playing surface to inwardly flex areas of said first sheet at said contact locations so as to force said contact pairs into mutual electrical contact whereby a game event is signalled, said game construction being a pinball machine, and said playing piece being a spherical ball adapted to roll about said playing surface.

2. The game construction of claim 1, said first and second sheets being integral with each other and interconnected along a fold line.

3. The game construction of claim 1, said means for signalling a game event including microelectronic circuitry as a game processor input subsystem and an alpha-numeric scorekeeping readout.

4. The game construction of claim 1, said first sheet outer surface having a decorative format applied thereto by sublimation printing.

5. The game construction of claim 1, said opposed contact portions of said circuits including at least one longitudinally oriented contact bar of a longitudinal extent generally spanning a respective intermediate sheet opening and of a minor width dimension substantially less than said respective sheet opening and wherein the contact bar of one of a selected pair of contacts is adapted to contact the contact bar of the other of said selected contact pair in criss-cross fashion.

6. The game construction of claim 5, wherein generally each of said contacts is of a cross shaped configuration including a pair of contact bars.

7. A game construction comprising a housing, a game board supported by said housing, said game board having a playing surface formed by the outer surface of a pressure sensitive flexible first sheet, a first partial electrical circuit disposed on the inner surface of said first sheet, a second partial electrical circuit complementary to said first partial circuit positioned in spaced relation to the inner surface of said first sheet with selected portions of each of said circuits opposed to each other to form pairs of opposed contacts, means operatively associated with said circuits for signalling a game event when one of said contact pairs are in contact with each other, means for normally maintaining said contact pairs apart from each other, and a playing piece adapted to be supported by and to move across said playing surface and inwardly flex areas of said sheet proximal said selected first circuit contact portions when overlying said areas so as to force said contact pairs into mutual electrical contact whereby a game event is signalled, said game being a pinball machine and said playing piece being a spherical ball adapted to roll about said playing surface, said game including tilt means, said tilt means including a secondary compartment disposed above a portion of said first sheet and having a secondary game piece movable therein from a normal position to a displaced tilt position within said compartment and a tilt contact pair disposed beneath said tilt position so as to effect a tilt signal when said secondary piece depresses said first sheet above said tilt contact pair as when said housing is tilted from its normal operation disposition.

* * * * *